United States Patent [19]

Bujacich

[11] Patent Number: 4,748,927

[45] Date of Patent: Jun. 7, 1988

[54] MEANS AND A METHOD FOR POSITIONING A STABILIZER ON A BOAT

[76] Inventor: John S. Bujacich, 3323 Ross Ave., Gig Harbor, Wash. 98332

[21] Appl. No.: 705,885

[22] Filed: Nov. 1, 1985

[51] Int. Cl.[4] ..... B63B 39/00

[52] U.S. Cl. ..... 114/121; 114/122; 242/157 R

[58] Field of Search ..... 114/121, 122, 123, 124, 114/126, 179–181, 240 A, 240 B, 242, 244, 246, 51, 365, 366; 254/325, 334; 242/157 R

[56] References Cited

U.S. PATENT DOCUMENTS

| | | | |
|---|---|---|---|
| 1,253,482 | 1/1918 | Gault | 114/51 X |
| 2,561,539 | 7/1951 | Seward | 114/126 |
| 2,734,475 | 2/1956 | Fyock | 114/210 |
| 3,029,767 | 4/1962 | Donnan | 114/121 |
| 3,064,613 | 11/1962 | Hubick | 114/121 |
| 3,260,232 | 7/1966 | Douglas | 114/126 |
| 3,952,680 | 4/1976 | Griffin | 114/123 |
| 4,182,255 | 1/1980 | Reid | 114/126 |
| 4,388,709 | 6/1983 | Reed et al. | 114/244 X |
| 4,462,330 | 7/1984 | Campbell et al. | 114/244 |
| 4,497,471 | 2/1985 | Longberg | 114/179 X |

FOREIGN PATENT DOCUMENTS

| | | | |
|---|---|---|---|
| 96050 | 3/1960 | Norway | 114/122 |
| 213920 | 6/1967 | Sweden | 212/190 |

OTHER PUBLICATIONS

Astor Marine Inc., Advertisement in "The Fish Boat", Jul. 1984.

*Primary Examiner*—Joseph F. Peters, Jr.
*Assistant Examiner*—Paul E. Salmon
*Attorney, Agent, or Firm*—Thomas W. Secrest

[57] ABSTRACT

My invention is directed to a means and method for positioning a stabilizer on a boat such as a small pleasure boat and a fishing boat. There is a boom on the deck of the fishing boat. The guide on the end of the boom assists in positioning the line and the stabilizer on the end of the line away from the hull of the boat.

13 Claims, 3 Drawing Sheets

MEANS AND A METHOD FOR POSITIONING A STABILIZER ON A BOAT

THE BACKGROUND OF THE INVENTION

Small boats as exemplified by pleasure boats and fishing boats are subject to wave action and among other things roll and pitch with the waves. Many times for the occupant of a small boat the roll and pitch action are not pleasant sensations. Also, they may interfere with the work on the boat such as with the hauling in of fish in the nets.

The small boats while docked or anchored or moving slowly or standing still are subject to the wave action.

Over the years there have been efforts to stabilize a small boat against wave action. There is a patent to Donnan, U.S. Pat. No. 3,029,767, issuing date of Apr. 17 1962, entitled BOAT STABILIZER.

Donnan teaches the use of a boat stabilizer suspended from the sides and the bow of a small boat such as a pleasure boat. The stabilizer comprises a frame with rotatable plates. With the lowering of the stabilizer into the water the plates can rotate upwardly. However, if there is a tendency for the boat to rise because of wave action the rotatable plates will not rotate downwardly and thereby tend to stabilize the motion of the boat with a rising wave. In other words, the boat stabilizers assist in stabilizing the small boat against a roll and also against a pitch.

There is a patent to Hubick, U.S. Pat. No. 3,064,613, issuing date of Nov. 20 1962 entitled STABILIZER FOR BOATS. Hubick teaches of a stabilizer in the configuration of a frustrum of a cone with the larger opening at the top. The stabilizer is suspended by means of a chain or the like from the side of the small boat. The reader can readily realize that with a rising wave the stabilizer tends to keep the boat from rising rapidly. Hubick also teaches of two of these frustrums of a cone positioned so that the small diameters are adjacent to each other. Again, the stabilizer of Hubick assists in protecting the small boat against roll and also against pitch.

There is a patent to Griffin, U.S. Pat. No. 3,952,680, issuing date of Apr. 27, 1976 entitled ROLL STABILIZER FOR VESSELS AT REST. Griffin teaches of a boom on a small boat and which boom can be raised or lowered. On the end of the boom is a stabilizer disc. With the boom in a lowered position and the stabilizer disc partially in the water the stabilizer of Griffin protects against roll and pitch and even protects against yaw. Griffin can elevate the boom and disc out of the water so that there is no hindrance or drag while the small boat is moving in the water.

There is a patent to Reid, U.S. Pat. No. 4,182,255, issuing date of Jan. 8, 1980 and entitled BELOW WATERLINE DEPLOYABLE HULL STABILIZING MEMBERS. Reid teaches of a boom positioned on the outside of the hull of a boat. On the end of the boom there is a panel. The stabilizer of Reid stabilizes against roll and pitch.

For many boats it is not appropriate to have chains and lines over the side or over the sides of the boat and it is not appropriate to have a boom attached to the hull of the boat.

In certain boats such as a small fishing boat there is an upright standard. There can be a pulley on the upright standard. It is possible to rotate the upright standard so that the end of the standard and the pulley at the end of the standard overlies the water. A stabilizer can connect by means of a line with the pulley and the upright standard. The line can be lowered so that the stabilizer is in the water and the stabilizer can be a frustrum of a cone like Hubick or can be a panel like Griffin or can be some other appropriate shape. The stabilizer in the water assists in protecting against roll and pitch.

I have worked on fishing boats and have used various stabilizers and consider that the stabilizers I have used and the means for raising and lowering these stabilizers to be cumbersome and awkward. Therefore, I have invented the stabilizer of this subject patent application.

A BRIEF DESCRIPTION OF THE INVENTION

My invention is directed to a means and a method for positioning a stabilizer on a boat such as a small pleasure boat and a fishing boat.

There is a boom on the deck of the fishing boat. On the upper end of the boom there is a guide for a chain or line connecting with the stabilizer. There is means for allowing the boom to rotate downwardly so that the end of the boom and the guide overlies the water and does not overlie the boat. Also, there is means to allow the line and the stabilizer on the end of the line to descend into the water. The stabilizer in the water is spaced apart from the boat and adds stability to the boat to protect against roll and pitch. The guide on the end of the boom assists in positioning the line and the stabilizer on the end of the line away from the hull of the boat.

THE DRAWINGS

Figure 3:
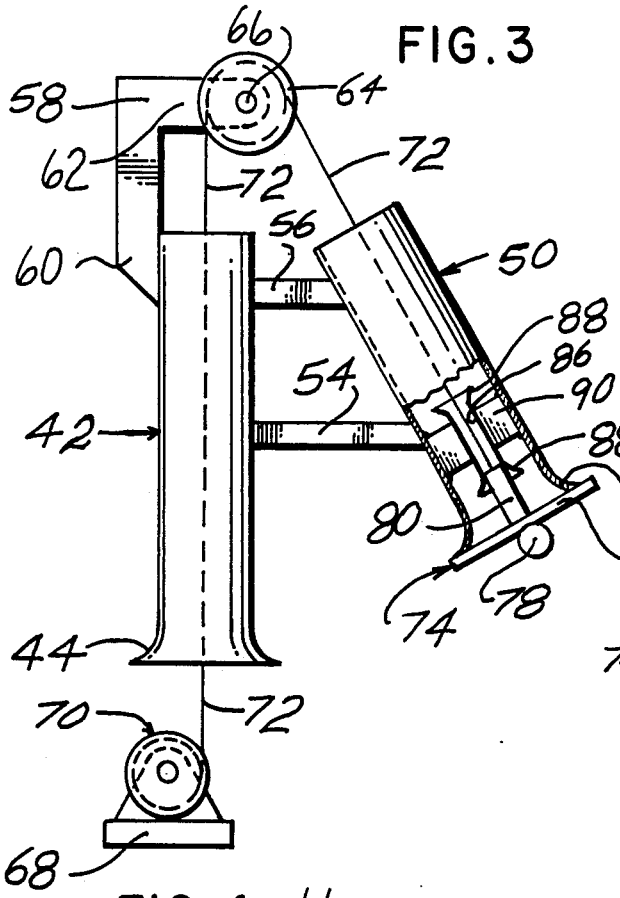
Figure 5:
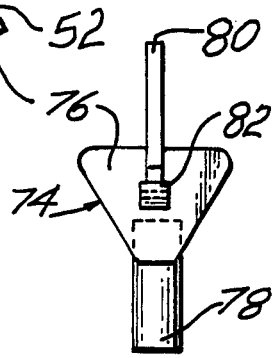
Figure 4:
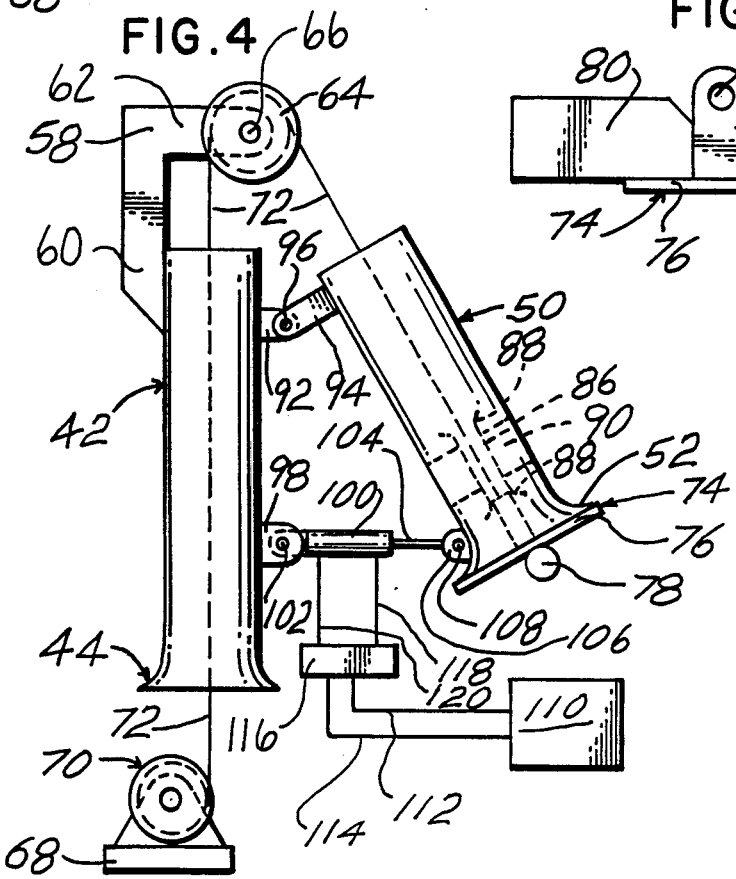
Figure 6:
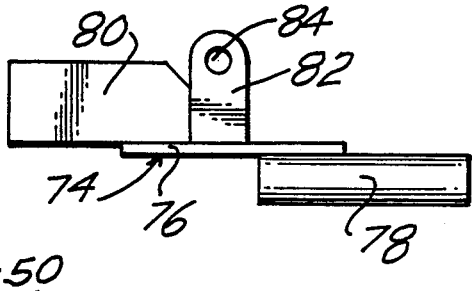

FIG. 3, on an enlarged scale, is a fragmentary view looking at the guide which can be positioned on the upper end of the standard and illustrates the details of construction of the guide and is in a lateral longitudinal cross sectional illustration;

FIG. 4 is a fragmentary enlarged view showing the guide, in another species, and with a fluid actuated cylinder and ram for locating the outer guide tube or second guide tube with respect to the first guide tube or upright guide tube;

FIG. 5 is a top plan view of a stabilizer which can be used with a boat and illustrates a triangular plate, a stabilizing fin and a weight; and FIG. 6 is a side elevational view of the stabilizer illustrating the triangular plate, the weight underneath, the fin and fastening lug.

THE SPECIFIC DESCRIPTION OF THE INVENTION

In the drawings there is illustrated the invention and also the invention as placed on a boat.

There is a body of water 20 supporting a boat 22.

The boat 22 has a deck 23. There is positioned on the deck 23 the stabilizer. In fact, there is positioned on the deck 23 a stabilizer for the port side and a stabilizer for the starboard side. Because the stabilizer for the port side is the same as the stabilizer for the starboard side only one set of reference numerals will be employed.

On the deck 23 in the central part it is seen that there is an upright structure 24.

To the left and also to the right of this upright structure there is positioned a rotatable support 26. On the deck 23 there is a base 28. A pin 30 or a shaft 30 connects the base 28 and the rotatable support 26 so that the support 26 can move and rotate with respect to the base 28.

Also, to the right and to the left of the upright structure 24 there is a pad 32. There is positioned on each of the pads 32 a winch 34.

On the left of the upright structure 24 there is a brace 36 and likewise on the right there is a brace 36. Each of the braces 36 positions and supports a pulley 38.

On that part of the rotatable support 26 facing the structure 24 there is an attaching lug 40.

It is seen that juxtapositioned on the outside of the rotatable support 26 that there is a guide tube 42 having a lower or bottom flared end 44.

It is seen that there are two spaced apart braces 46 and 48 operatively connecting with the rotatable support 26 and the guide tube 42.

There is a second guide tube 50. The second guide tube 50 has a flared lower end 52.

Also, there are two spaced apart braces 54 and 56 operatively connecting with the guide tube 42 and with the guide tube 50.

On the upper part of the guide tube 42 there is a right angle support 58 having an upright arm 60 or a first arm 60 attaching to the guide tube 42. The right angle support 58 also has an angled arm or a second arm 62 connecting with the arm 60. There is a pulley 64. A shaft or pin 66 connects with the angled arm 62 and the pulley 64 so that the pulley 64 can rotate with respect to the arm 62.

On the deck 23 it is seen that there is a pad 68 and a winch 70 is mounted on this pad. A cable 72 connects with the winch 70 and passes around the pulley 64 and connects with a stabilizer 74.

In FIGS. 5 and 6 it is seen that the stabilizer 74 comprises a trapezoidal plate 76, a cylindrical tube 78, a fin 80, and an attaching lug 82 with a hole 84 in the upper end. The trapezoidal plate 76 is of metal. On the lower surface and the small end of the plate 76 there is a cylindrical tube way 78.

On the upper surface of the plate 76 and the large end there is the fin plate 80.

The hole 84 in the attaching lug 82 allows the connecting means to connect with the stabilizer 74.

The stabilizer 74 weighs about 25 to 30 pounds. The long end of the plate 76 is about 18 inches to 19 inches and the short end is about 3 inches. The length of the plate 76 is about 12 inches. The tube 78 is approximately 6 inches long and about 2½ inches in diameter. The fin 80 is about 10 inches long and 7 inches high. The attaching lug is about 2 inches wide and about 9 inches high. The reader is to understand that various sized stabilizers can be used. The foregoing dimensions are for one particular stabilizer which has been made for experimental purposes.

A cable 49 operatively connects with the winch 34 and the attaching lug 40 on the rotatable support 26.

Figure 1:
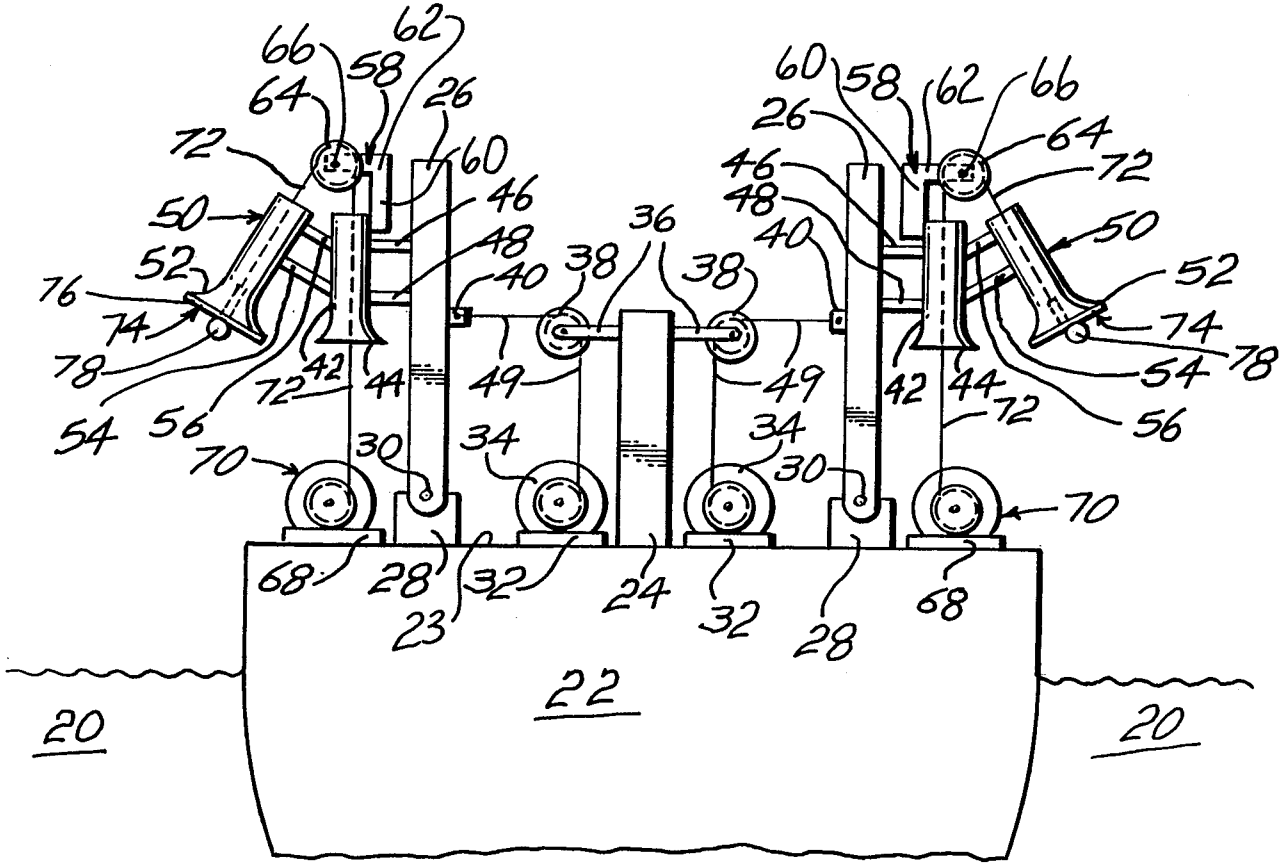
FIG. 1 is a schematic illustration of a boat, a standard in an upright position on the boat, a guide on the upper end of the standard for guiding a line connecting with a drum on the boat and also connecting with the stabilizer on the outer end of the line.

In FIG. 1 it is seen that the cable 49 is pulled tight and that the rotatable support 26 is upright and therefore the guide tube 42 is upright. Also, the cable 72 is pulled tight and the stabilizer 74 is pulled tight and is flush against the flared lower end 52 of the guide tube 50.

Figure 2:
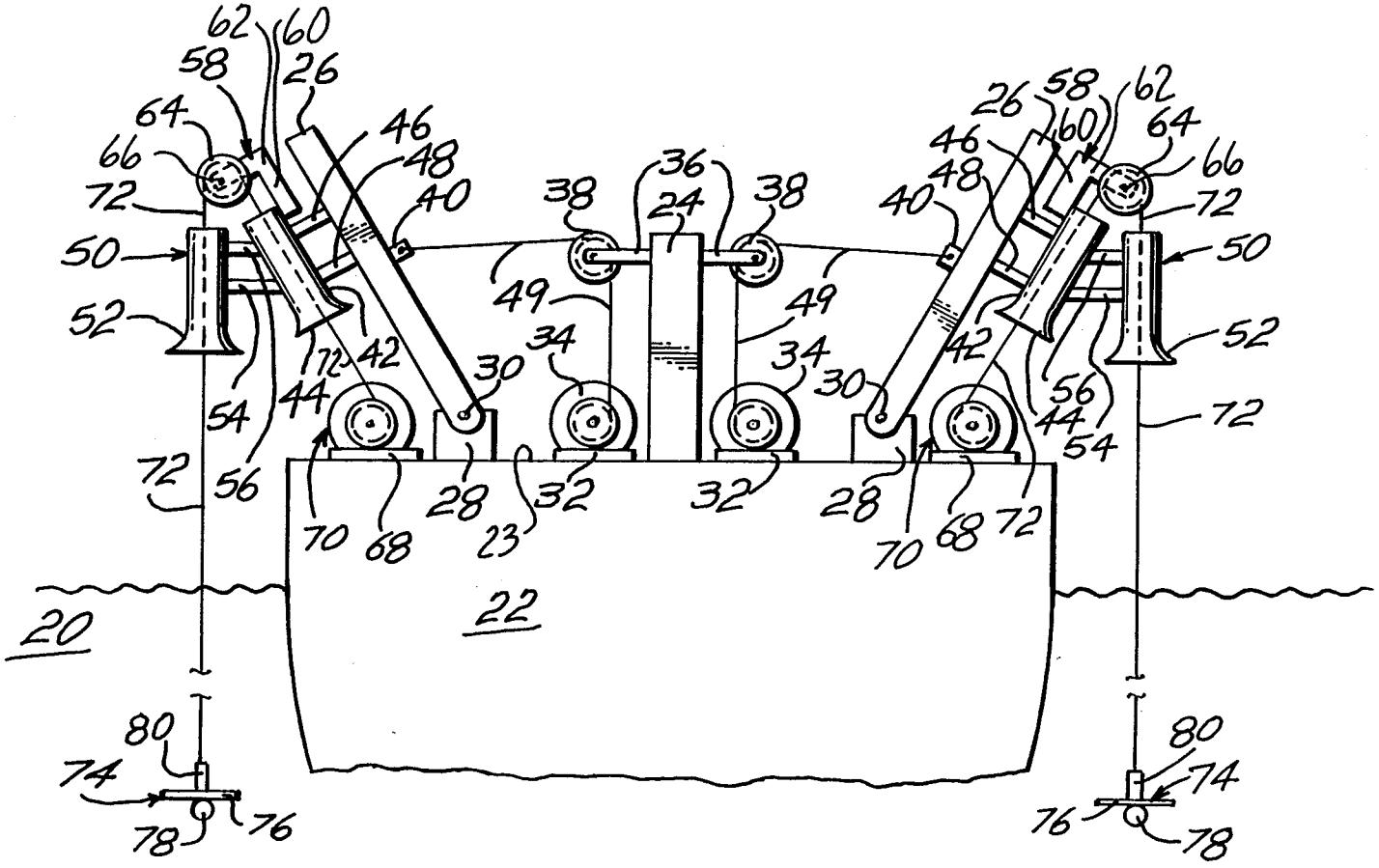
FIG. 2 is a schematic illustration of a boat, a standard at a lowered position and with the guide on the outer end of the standard overlying the water and outside of the hull of the boat and with a line passing through the guide and with a stabilizer on the lower end of the line and in the water.

In FIG. 2 it is seen that the cable 49 has been played out and that the rotatable support 26 has rotated around the shaft 30 or pin 30 so as to position the rotatable support 26 at an angle with the vertical and to position the guide tube 50 over the water 20. Also, the cable 72 has been played out and has allowed the stabilizer 74 to be under the surface of the water 20 and in the water. In fact, both of the stabilizers 74 are under the surface of the water 20 and in the water 20 to assist in stabilizing the motion of the boat 22.

In the drawings it is seen that the lower end of the guide 42 is flared outwardly and also that the lower end of the guide tube 50 is flared outwardly. A reason for this is that if the cable 72 contacts the end of the guide tube 42 or contacts the end of the guide tube 50 then the cable will not be abraded and will slide easily over the end of the guide tube. This is a safety feature to decrease the wear on the cable 72. The effect is that the cable 72 may have a longer life with the flared ends of the guide tubes 42 and 50.

The cable 72 can be a wire rope cable or a manilla rope cable, or conceivably, a chain.

In FIG. 1 the stabilizer 74 is drawn tight and is flush against the end of the guide tube 50. If, by accident, or by design, the cable 72 is played out and the stabilizer 74 allowed to descend it is possible that the cable 72 could rub against and travel against the lower end of the guide tube 50. If the guide tube 50 were not flared as illustrated at its flared lower end 52 the cable would rub against the guide tube 50 and abrade part of the cable and also might cut the cable. The cutting of the cable could occur with the reeling in of the cable 72. Therefore, in order to lessen abrasion and wear on the cable 72 the lower end of the guide tube 50 is flared outwardly. I believe that this has a beneficial effect with respect to lengthening the life of the cable and also lessening the wear on the cable 72 and lessening the wear on the guide tube 50.

In FIG. 3 there is illustrated a refinement upon the lower flared end of the guide tube 50. The guide tube 50 in FIG. 3 still has the lower flared end but near the lower end of the guide tube 50 there is an inner guide tube 86. The inner guide tube 86 has both upper and lower flared ends 88. A brace 90 positions the inner guide tube 86 inside of the guide tube 50. The inner guide tube 86 more definitely positions the cable 72 with respect to the guide tube 50. The cable 72 is positioned at approximately the center or near the longitudinal center line of the guide tube 50. The pulley 64 and the inner guide tube 86 restrict the cable 72 to approximately the longitudinal center line of the guide tube 50. Again, the purpose of the inner guide tube 86 and the flared ends 88 is to lessen the wear on the cable 72 and to lessen the possibility of damaging the cable 72 and also to lessen the possibility of damaging the guide tube 50.

In FIG. 4 there is illustrated another species of the invention. There is the guide tube 42, the guide tube 50 and the inner guide tube 86. In place of the braces 54 and 56 there are movable units. It is seen that near the upper part of the guide tube 42 that there is a lug 92. Also, near the upper part of the guide tube 50 there is a lug 94. A pin 96 operatively connects together the lug 92 and 94 so that these two lugs can move and rotate with respect to each other.

On the lower part of the guide tube 42 there is a lug 98. There is a fluid actuated cylinder 100. A pin 102 operatively connects together the lug 98 and the fluid actuated cylinder 100 so that they can move and rotate with respect to each other. The fluid actuated cylinder 100 has a ram 104.

On the lower part of the guide tube 50 there is a lug 106. A pin 108 operatively connects together the ram 104 and the lug 106 so that the two can move and rotate with respect to each other.

There is a motor and pump unit 110. The motor and pump unit connects with hydraulic lines 112 and 114. The hydraulic lines 112 and 114 connect with the control valve 116. The control valve 116 by means of lines 118 and 120 connect with the fluid actuated cylinder 100. It is possible by means of the fluid actuated cylinder 100 to move and to rotate the guide tube 42 and the guide tube 50 with respect to each other so as to have the two move close to each other or the two to move away from each other. This arrangement makes it possible to make certain that the cable 72 does not come in contact with the guide tube 50. Therefore, there is no wear and tear on the cable 72 and there is no possibility of the cable 72 being cut while being near the guide tube 50.

From the foregoing it is seen that I have provided a stabilizing means for a boat and comprising: a support; a guide means operatively connecting with said support; a first guide tube operatively connecting with said support; a first cable operatively connecting with said guide means and said first guide tube; a stabilizer operatively connecting with said first cable; a means operatively connecting with said first cable for moving said stabilizer adjacent to said first guide tube and for allowing said stabilizer to move away from said first guide tube; a base; said support being operatively pivoted to said base; a means operatively connecting with said support to vary the position of said support from an upright position to a position at an angle with the upright position; said first guide tube being an outer guide tube having an upper end and a lower end; said lower end being flanged outwardly; said guide means comprising a second guide tube and a pulley; said second guide tube operatively connecting with said support; said pulley operatively connecting with said support; said cable being in said second guide tube and positioned on said pulley and being in said first guide tube and connecting with said stabilizer near that end of said first guide tube away from said pulley; an inner guide in said first guide tube and being positioned near that end of said first guide tube that said stabilizer approaches with said cable moving said stabilizer toward said first guide tube; said first cable being in said inner guide tube; said means operatively connecting with said first cable being a first winch; said means operatively connecting with said support comprising a second winch and a second cable; said second cable connecting with said support and said second winch; a variable positioning means operatively connecting with said first guide tube and with said support for varying the position of said first guide tube and said support with respect to each other; said variable positioning means comprising a fluid actuated cylinder and a ram and a means for flowing fluid to said cylinder for moving said support and said first guide tube with respect to each other.

This invention when used on the port and starboard side of a boat assists in dampening and lessening the roll of the boat. It is conceivable that this invention can be used on the bow of a boat and even used on the stern of a boat. With the invention on the bow and the stern of the boat there is a dampening of the pitch of the boat.

One of the objects of this invention is to lessen the roll of a small boat and also to lessen the pitch of a small boat and a small boat being defined as a pleasure boat, a power boat, a sailing boat, a fishing boat and a laboratory boat.

Another object and advantage of this invention is that when the invention is not in use it can be stored on the boat in an out of the way place and while being stored does not hinder the operation of the boat or the crew or the passengers.

Another advantage of this invention is that when it is in use it is not in the way of the crew of the boat and is not in the way of the passengers.

A further object of this invention is that the unit is positive in its action and will position the stabilizer over the side of the boat and in the water for stabilization purposes.

35 U.S.C. 101 states:

"Whoever invents or discovers any new and useful process, machine, manufacture, or composition of matter, or any new and useful information thereof, may obtain a patent therefor, subject to the conditions and requirements of this title."

35 U.S.C. 103 states:

"A patent may not be obtained though the invention is not identically disclosed or described as set forth in section 102 of this title, if the differences between the subject matter sought to be patented and the prior art are such that the subject matter as a whole would have been obvious at the time the invention was made to a person having ordinary skill in the art to which said subject matter pertains. Patentability shall not be negatived by the manner in which the invention was made."

I consider the invention to be new and unobvious. Prior to preparing this patent application a patent search was made and no similar invention was found. I am a commercial fisherman and do not know of a similar invention.

I consider the invention to be useful. Again, I am a commercial fisherman in a small boat and fish in Puget Sound, Southeastern Alaska and Bristol Bay. I consider that this invention will assist in stabilizing the commercial fishing boat and that it will be easier to do commercial fishing.

In place of the stabilizer 74 which I have described in this instrument it is possible to use other stabilizers. Some of the other stabilizers which can be used are the rotatable plate of Donnan; the frustrum of a cone as described by Hubick; a stabilizer disc such as illustrated and described by Griffin; and, a panel as illustrated and described by Reid. The stabilizer is a dampening means and resists upward movement so as to dampen the roll of the boat and also the pitch of the boat.

From the foregoing and having presented my invention, what I claim is:

1. A combination of a boat and a stabilizing means for said boat and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable;
f. a stabilizing means being positioned on said boat;
g. a variable positioning means operatively connecting with said first guide tube and with said support for varying the position of said first tube and said support with respect to each other; and,
h. said variable positioning means comprising a fluid actuated cylinder and a ram and a means for flowing fluid to said cylinder for moving said support and said first guide tube with respect to each other.

2. A combination of a boat and a stabilizing means for said boat and comprising:
a. a support;
b. a guide means operatively connecting with said support;
c. a first guide tube operatively connecting with said support;
d. a first cable operatively connecting with said guide means and said first guide tube;
e. a stabilizer operatively connecting with said first cable;
f. said stabilizing means being positioned on said boat;
g. a variable positioning means operatively connecting with said first guide tube and with said support for varying the position of said first guide tube and said support with respect to each other;
h. said variable positioning means comprising a fluid actuated cylinder and a ram and a means for flowing fluid to said cylinder for moving said support and said first guide tube with respect to each other;
i. one of said stabilizing means being associated with the portside of said boat; and,
j. one of said stabilizing means being associated with the starboard side of said boat.

3. A stabilizing means for a boat and comprising:
a. a support;
b. a guide means operatively connecting with said support;
c. a first guide tube operatively connecting with said support;
d. a first cable operatively connecting with said guide means and said first guide tube;
e. a stabilizer operatively connecting with said first cable;
f. a base;
g. said support being operatively pivoted to said base;
h. a means operatively connecting with said support to vary the position of said support from an upright position to a position at an angle with the upright position;
i. a variable positioning means operatively connecting with said first guide tube and with said support for varying the position of said first guide tube and said support with respect to each other; and
j. said variable positioning means comprising a fluid actuated cylinder and a ram and a means for flowing fluid to said cylinder for moving said support and said first guide tube with respect to each other.

4. A stabilizing means for a boat and comprising:
a. a support;
b. a guide means operatively connecting with said support;
c. a first guide tube operatively connecting with said support;
d. a first cable operatively connecting with said guide means and said first guide tube;
e. a stabilizer operatively connecting with said first cable;
f. a means operatively connecting with said first cable for moving said stabilizer adjacent to said first guide tube and for allowing said stabilizer to move away from said first guide tube;
g. a base;
h. said support being operatively pivoted to said base;
i. a means operatively connecting with said support to vary the position of said support from an upright position to a position at an angle with the upright position;
j. said first guide tube being an outer guide tube having an upper end and a lower end;
k. said lower end being flanged outwardly;
l. said guide means comprising a second guide tube and a pulley;
m. said second guide tube operatively connecting with said support;
n. said pulley operatively connecting with said support;
o. said cable being in said second guide tube and positioned on said pulley and being in said first guide tube and connecting with said stabilizer near that end of said first guide tube away from said pulley;
p. a variable positioning means operatively connecting with said first guide tube and with said support for varying the position of said first guide tube and said support with respect to each other; and,
q. said variable positioning means comprising a fluid actuated cylinder and a ram and a means for flowing fluid to said cylinder for moving said support and said first guide tube with respect to each other.

5. A stabilizing means for a boat and comprising:
a. a support;
b. a guide means operatively connecting with said support;
c. a first guide tube operatively connecting with said support;
d. a first cable operatively connecting with said guide means and said first guide tube;
e. a stabilizer operatively connecting with said first cable;
f. a means operatively connecting with said first cable for moving said stabilizer adjacent to said first guide tube and for allowing said stabilizer to move away from said first guide tube;
g. a base;
h. said support being operatively pivoted to said base;
i. a means operatively connecting with said support to vary the position of said support from an upright position to a position at an angle with the upright position;
j. said first guide tube being an outer guide tube having an upper end and a lower end;
k. said lower end being flanged outwardly;
l. said guide means comprising a second guide tube and a pulley;
m. said second guide tube operatively connecting with said support;
n. said pulley operatively connecting with said support;
o. said cable being in said second guide tube and positioned on said pulley and being in said first guide tube and connecting with said stabilizer near that end of said first guide tube away from said pulley;

p. said means operatively connecting with said first cable being a first winch;

q. said means operatively connecting with said support comprising a second winch and a second cable;

r. said second cable connecting with said support and said second winch;

s. a variable positioning means operatively connecting with said first guide tube and with said support for varying the position of said first guide tube and said support with respect to each other; and, t. said variable positioning means comprising a fluid actuated cylinder and a ram and a means for flowing fluid to said cylinder for moving said support and said first guide tube with respect to each other.

6. A stabilizing means for a boat and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable;

f. a means operatively connecting with said first cable for moving said stabilizer adjacent to said first guide tube and for allowing said stabilizer to move away from said first guide tube;

g. a base;

h. said support being operatively pivoted to said base;

i. a means operatively connecting with said support to vary the position of said support from an upright position to a position at an angle with the upright position;

j. said first guide tube beign an outer guide tube having an upper end and a lower end;

k. said lower end being flanged outwardly;

l. said guide means comprising a second guide tube and a pulley;

m. said second guide tube operatively connecting with said support;

n. said pulley operatively connecting with said support;

o. said cable being in said second guide tube and positioned on said pulley and being in said first guide tube and connecting with said stabilizer near that end of said first guide tube away from said pulley;

p. an inner guide in said first guide tube and being positioned near that end of said first guide tube that said stabilizer approaches with said cable moving said stabilizer toward said first guide tube;

q. said first cable being in said inner guide tube;

r. said means operatively connecting with said first cable being a first winch;

s. said means operatively connecting with said support comprising a second winch and a second cable;

t. said second cable connecting with said support and said second winch;

u. a variable positioning means operatively connecting with said first guide tube and with said support for varying the the position of said first guide tube and said support with respect to each other; and, v. said variable positioning means comprising a fluid actuated cylinder and a ram and a means for flowing fluid to said cylinder for moving said support and said first guide tube with respect to each other.

7. A stabilizing means for a boat on water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position on said boat said support being in an upright position over said deck and said stabilizer and said support are in an out of the way place so as to not hinder the operation of the boat;

h. with said stabilizer being in the water said support overlying said deck, the side of the boat and the water;

i. said guide means comprising a second guide tube and a pulley;

j. said second guide tube operatively connecting with said support;

k. said pulley operatively connecting with said support;

l. said cable being in said second guide tube and positioned on said pulley and being in said first guide tube and connecting with said stabilizer near that end of said first guide tube and away from said pulley;

m. said pulley being positioned away from and outside said first guide tube and outside said second guide tube;

n. an inner guide tube in said first guide tube and being positioned near that end of said first guide tube that said stabilizer approaches with said first cable moving said stabilizer toward said first guide tube; and, o. said first cable being in said inner guide tube.

8. A stabilizing means for a boat on water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position on said boat said support being in an upright position over said deck and said stabilizer and said support are in an out of the way place so as to not hinder the operation of the boat;

h. with said stabilizer being in the water said support overlying said deck, the side of the boat and the water;

i. said guide means comprising a second guide tube and a pulley;

j. said second guide tube operatively connecting with said support;

k. said pulley operatively connecting with said support;

l. said cable being in said second tube and positioned on said pulley and being in said first guide tube and connecting with said stabilizer near that end of said first guide tube and away from said pulley;

m. said pulley being positioned away from and outside said first guide tube and outside said second guide tube;

n. a inner guide tube in said first guide tube and being positioned near that end of said first guide tube that said stabilizer approaches with said first cable moving said stabilizer toward said first guide tube;

o. said first cable being in said inner guide tube;

p. said means operatively connecting with said first cable being a first winch;

q. said means operatively connecting with said support comprising a second winch and a second cable; and, r. said second cable connecting with said support and said second winch.

9. A stabilizing means for a boat on water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position in said boat said support being on an upright position over said deck and said stabilizer and said support are in an out of the way place so as to not hinder the operation of the boat;

h. with said stabilizer being in the water said support overlying said deck, the side of the boat and the water;

i. said guide means comprising a second guide tube and a pulley;

j. said second guide tube operatively connecting with said support;

k. said pulley operatively connecting with said support;

l. said cable being in said second guide tube and positioned on said pulley and being in said first guide tube and connecting with said stabilizer near that end of said first guide tube and away from said pulley;

m. said pulley being positioned away from and outside said first guide tube and outside said second guide tube;

n. an inner guide tube in said first guide tube and being positioned near that end of said first guide tube that said stabilizer approaches with said first cable moving said stabilizer toward said first guide tube;

o. said first cable being in said inner guide tube;

p. said means operatively connecting with said first cable being a first winch;

q. said means operatively connecting with said support comprising a second winch and a second cable;

r. said second cable connecting with said support and said second winch;

s. a variable positioning means operatively connecting with said first guide tube and with said support for varying the position of said first guide tube and said support with respect to each other.

10. A stabilizing means for a boat on water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position on said boat said support being in an upright position over said deck and said stabilizer and said support are in an out of the way plcae so as to not hinder the operation of the boat;

h. with said stabilizer being in the water said support overlying said deck, the side of the boat and the water;

i. a variable positioning means operatively connecting with said first guide tube and with said support for varying the position of said first guide tube and said support with respect to each other;

j. said stabilizer comprising a plate having an upper surface and a lower surface;

k. a tube attached to said plate and on the lower surface of said plate and extending beyond said plate;

l. a fin attached to said plate and on the upper surface of said plate and extending beyond said plate;

m. an attaching means attached to said plate and on the upper surface of said plate; and, n. with said first cable pulling said stabilizer to said first guide tube said fin and said attaching means are in said first guide tube and said plate adjacent to said first guide tube.

11. A stabilizing means for a boat on water and comprising:

a. a support;

b. a guide means operatively connecting with said said support;

c. a first guide tube operatively connecting with said support;

d. a first cable operatively connecting with said first means and said first guide tube;

e. a stabilizer operatively connecting with said first cable and for being positioned entirely in the wtaer and under the surface of the water;

f. said boat having a deck;

g. with said stabilizer in a stored position on said boat said support being in an upright position over said deck and said stabilizer and said support are in an out of the way place so as to not hinder the operation of the boat;

h. with said stabilizer being in the water said support overlaying said deck, the side of the boat and the water;

i. a means operatively connecting with said first cable for moving said stabilizer adjacent to said first guide tube and for allowing said stabilizer to move away from said first guide tube;

j. a base;

k. said support being operatively pivoted to said base;

l. a means operatively connecting with said support to vary the position of said support from said upright position to a position at an angle with respect to said upright position and overlying the water;

m. said first guide tube being an outer guide tube having an upper end and a lower end;

n. said lower end being flanged outwardly;

o. said guide means comprising a second guide tube and a pulley;

p. said second guide operatively connecting with said support;

q. said pulley operatively connecting with said support;

r. said cable being in said second guide tube and positioned on said pulley and being in said first guide tube and connecting with said stabilizer near that end of said first guide tube and away from said pulley;

s. said pulley being positioned away from and outside said first guide tube and outside said second guide tube;

t. a variable positioning means operatively connecting with said first guide tube and with said support for varying the position of said first guide tube and said support with respect to each other;

u. said stabilizer comprising a plate having an upper surface and a lower surface;

v. a tube attached to said plate and on the lower surface of said plate and extending beyond said plate;

w. a fin attached to said plate and on the upper surface of said plate and extending beyond said plate;

x. an attaching means to said plate and on the upper surface of said plate; and, y. with said first cable pulling said stabilizer to said first guide tube said fin and said attaching means are in said first guide tube and said plate adjacent to said first guide tube.

12. A stabilizing means for a boat on the water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position on said boat said support being in an upright position over said deck and said stabilizer and said support are in an out of the way place so as to not hinder the operation of the boat;

h. with said stabilizer being in the water said support overlying said deck, the side of the boat and the water;

i. a means operatively connecting with said first cable for moving said stabilizer adjacent to said first guide tube and for allowing said stabilizer to move away from said first guide tube;

j. a base;

k. said support being operatively pivoted to said base;

l. a means operatively connecting with said support to vary the position of said support from said upright position and to a position at an angle with respect to upright position and overlying the water;

m. said first guide tube being an outer guide tube having an upper end and a lower end;

n. said lower end being flanged outwardly;

o. said guide means comprising a second guide tube and a pulley;

p. said second guide tube operatively connecting with said support;

q. said pulley operatively connecting with said support;

r. said cable being in said second guide tube and positioned on said pulley and being in said first guide tube and connecting with said stabilizer near that end of said first guide tube and away from said pulley;

s. said pulley being positioned away from and outside said first guide tube and outside said second guide tube;

t. a variable positioning means operatively connecting with said first guide tube and with said support for varying the position of said first guide tube and said support with respect to each other;

u. said stabilizer comprising a plate having an upper surface and a lower surface;

v. a tube attached to said plate and on the lower surface of said plate and extending beyond said plate;

w. a fin attached to said plate and on the upper surface of said plate an extending beyond said plate;

x. an attaching means attached to said plate and on the upper surface of said plate; and, y. with said first cable pulling said stabilizer to said first guide tube said fin and said attaching means are in said first guide tube and said plate adjacent to said first guide tube.

13. A stabilizing means for a boat on water and comprising:

a. a support;

b. a guide means operatively connecting with said support;

c. a first guide tube operatively connecting with said support;

d. a first cable operatively connecting with said guide means and said first guide tube;

e. a stabilizer operatively connecting with said first cable and for being positioned entirely in the water and under the surface of the water;

f. said boat having a deck;

g. with said stabilizer in a stored position on said boat said support being in an upright position over said deck and said stabilizer and said support are in an out of the way place so as to not hinder the operation of the boat;

h. with said stabilizer being in the water said support overlying said deck, the side of the boat and the water;

i. said guide means comprising a second guide tube and a pulley;

j. said second guide tube operatively connecting with said support;

k. said pulley operatively connecting with said support;

l. said cable being in said second guide tube and positioned on said pulley and being in said first guide tube and connecting with said stabilizer near that end of said first guide tube and away from said pulley;

m. said pulley being positioned away from and outside said first guide tube and outside said second guide tube;

n. an inner guide tube in said first guide tube and being positioned near that end of said first guide tube that said stabilizer approaches with said first cable moving said stabilizer toward said first guide tube;

o. said first cable being in said inner guide tube;

p. said means operatively connecting with said first cable being a first winch;

q. said means operatively connecting with said support comprising a second winch and a second cable;

r. said second cable connecting with said support and said second winch;

s. a variable positioning means operatively connecting with said first guide tube and with said support for varying the position of said first guide tube and said support with respect to each other;

t. a stabilizer comprising a plate having an upper surface and a lower surface;

u. a tube attached to said plate and on the lower surface of said plate and extending beyond said plate;

v. a fin attached to said plate and on the upper surface of said plate and extending beyond said plate;

w. an attaching means attached to said plate and on the upper surface of said plate; and, x. with said first cable pulling said stabilizer to said first guide tube said fin and said attaching means are in said first guide tube and said plate adjacent to said first guide tube.

* * * * *